US008333609B2

(12) United States Patent
Sato et al.

(10) Patent No.: US 8,333,609 B2
(45) Date of Patent: Dec. 18, 2012

(54) CONNECTOR, MULTI-CHANNEL AUDIO SYSTEM, ELECTRONIC APPARATUS, AND CABLE FOR CONNECTION

(75) Inventors: Yutaka Sato, Kanagawa (JP); Kim Hung Tae, Kanagawa (JP); Takashi Seki, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/800,056

(22) Filed: Mar. 5, 2001

(65) Prior Publication Data

US 2001/0041476 A1 Nov. 15, 2001

(30) Foreign Application Priority Data

Mar. 6, 2000 (JP) ..... P2000-061224

(51) Int. Cl.
*H01R 3/00* (2006.01)

(52) U.S. Cl. ..... 439/491; 381/80

(58) Field of Classification Search ..... 439/680, 439/488, 491, 679; 381/18, 77, 80, 56, 58, 381/59, 124
See application file for complete search history.

(56) References Cited

U.S. PATENT DOCUMENTS

| | | | | |
|---|---|---|---|---|
| 3,824,524 | A * | 7/1974 | Glover | 439/680 |
| 5,470,253 | A * | 11/1995 | Siems et al. | 439/491 |
| 5,589,718 | A * | 12/1996 | Lee | 439/535 |
| 5,850,457 | A * | 12/1998 | Gefvert | 381/24 |
| 5,984,717 | A * | 11/1999 | Lee | 439/502 |
| 6,118,876 | A * | 9/2000 | Ruzicka | 381/18 |

FOREIGN PATENT DOCUMENTS

| | | | |
|---|---|---|---|
| JP | 54053687 | A | 4/1979 |
| JP | 55164781 | A | 12/1980 |
| JP | 56160748 | A | 12/1981 |
| JP | 60-136478 | A | 7/1985 |
| JP | 62058085 | A | 3/1987 |
| JP | 62167379 | A | 7/1987 |
| JP | 63-037258 | | 3/1988 |
| JP | 04053396 | A | 2/1992 |
| JP | 4-171685 | A | 6/1992 |
| JP | 07025589 | A | 1/1995 |
| JP | 08028749 | A | 2/1996 |
| JP | 09129311 | A | 5/1997 |
| JP | 10094086 | A | 4/1998 |
| JP | 11242970 | A | 9/1999 |
| JP | 2000040556 | A | 2/2000 |

OTHER PUBLICATIONS

English translation of Japanese Office Action issued on Nov. 12, 2009, issued in Japanese Patent Application No. 2000-061224.
Office Action from Japanese Application No. 2000-061224, dated Jul. 29, 2010.
Office Action from Japanese Application No. 2000-061224, dated Aug. 30, 2011.
Office Action from Japanese Application No. 2000-061224, dated May 17, 2011.

* cited by examiner

*Primary Examiner* — Felix O Figueroa
(74) *Attorney, Agent, or Firm* — Lerner, David, Littenberg, Krumholz & Mentlik, LLP

(57) ABSTRACT

A plurality of audio signal output terminals corresponding to individual channels of an audio-signal output apparatus are respectively disposed in correspondence with actual positions of a plurality of speakers disposed in correspondence with plural channels. Those audio signal output terminals provided for plural channels of the audio signal output apparatus are arranged to enable an user to discern individual audio signal output terminals by a color. Connecting cables are also provided with specific coloration corresponding to the colors provided for individual audio signal output terminals.

7 Claims, 14 Drawing Sheets

PRIOR ART

PRIOR ART

PRIOR ART

CONNECTOR, MULTI-CHANNEL AUDIO SYSTEM, ELECTRONIC APPARATUS, AND CABLE FOR CONNECTION

BACKGROUND OF THE INVENTION

1. Field of the Invention

The present invention relates to a multi-channel audio system using a number of speakers such as a home theater system, for example. In particular, the present invention relates to connection between an audio signal output apparatus and speakers used for such system. Further, the present invention also relates to an electronic apparatus fitted with audio signal output terminals suited for application to a multi-channel audio system, a connector apparatus, and connecting cables used therefor.

2. Description of the Related Art

In recent years, such a multi-channel speaker system capable of generating acoustic effects similar to effective acoustic output in viewing movies audible in a movie-theater has been introduced for household purposes. For example, when operating a so-called home theater system, six-channel speakers including a bass-output-only channel and a center channel are activated.

FIG. 10 exemplifies an arrangement of a conventional electronic apparatus and speakers installed in a home theater system. More particularly, in an example shown in FIG. 10, a TV monitor 1 is installed in front of a viewer 4, and yet, a DVD player 2 for reproducing a digital versatile disc (DVD) recorded with contents of a movie is installed in the vicinity of the TV monitor 1. A video signal output terminal is connected to a video signal input terminal of the TV monitor 1 to allow movie picture image to be reproduced on the screen of this TV monitor 1.

The above-referred DVD player 2 is provided with six-channel audio signal output terminals comprising a pair of front channels, another pair of rear channels, a center channel, and a bass-output-only channel, where audio signal output terminals corresponding to respective channels are connected to speakers 3FR, 3FL, 3RR, 3RL, 3C, and 3W linked with these channels. These speakers linked with the above-referred channels are disposed as described below, for example.

The above-referred pair of speakers 3FR (for front-right-channel) and the other pair of speakers 3FL (for front-left-channel) are respectively disposed on both sides of the TV monitor 1 across an even distance centering the TV monitor 1 in front of the viewer 4. The above-referred speaker 3C (for center channel) is disposed above or below the TV monitor 1. The above-referred speaker 3RR (for rear-right-channel) and the speaker 3RL (for rear-left-channel) are respectively disposed at a position higher than the position of viewer's ears. Further, the above-referred bass-output-only speaker 3W is disposed beside the TV monitor 1. The bass-output-only speaker 3W may be disposed at any position.

Although illustration is omitted in FIG. 10, the connection between respective audio signal output terminals of the DVD player 2 and the above-referred speakers 3FR, 3FL, 3RR, 3RL, 3C, and 3Wis implemented by means of connecting cables conventionally called "speaker cables". The audio signal output terminals comprise two terminals, a positive-side terminal and a negative-side terminal. Likewise, the speaker terminals comprise two terminals, a positive-side terminal and a negative-side terminal.

As shown in FIG. 11(A) and (B), in correspondence with the above-referred positive-side terminal and the negative-side terminal, the connecting cable 5 consists of a pair of cables integrated at sheathed portion each comprising a bundle of fine copper wires sheathed with sheathing member 6 made from polyvinyl chloride (PVC), for example.

Usually, a pair of the PVC-covered portions of each of the connecting cable 5, i.e., speaker cables, are split from each other at both ends as shown in FIG. 11 (A) and (B). The sheathing member 6 is stripped off at tip portions of both ends to expose the copper-wire-bundles. Tip portions 7 of the exposed copper-wire-bundles are connected to a pair of audio signal output terminals or a pair of terminals of each speaker unit. Copper-wire-bundles may previously be bonded at the tip portions 7 via a soldering process.

In order to ensure proper connection between audio signal output terminals and a pair of terminals of each speaker unit with correct arrangement of positive and negative polarities, sheathing member 6 for sheathing a pair of copper-wire-bundles of each of the connecting cable 5, i.e., speaker cables, is provided with different patterns as shown in FIG. 11(A) or different coloring as shown in FIG. 11(B).

Identical speaker cables 5 are used for connecting a plurality of audio signal output terminals of an electronic apparatus to the corresponding input terminals of a plurality of speaker units via a conventional method of winding a pair of tip portions 7 of copper-wire-bundles at both ends of the speaker cables 5 onto audio signal output terminals of an electronic apparatus and also onto input terminals of each speaker unit or via another conventional method of pinching the tip portions 7 into corresponding terminals. In this case, such setting operation requires special attention in order to properly connect the speaker cables 5 according to pattern or color of the sheathing material 6 of the speaker cables 5, without inverting the positive and negative polarities.

FIG. 12 exemplifies such a state in which tip portions 7 of exposed copper-wire bundles of the speaker cables 5 are wound to the corresponding audio output terminals of an electronic apparatus via the above-referred connecting method. When executing this method, audio output terminals of an electronic apparatus and corresponding input terminals of each speaker unit are provided with a specific form for allowing the tip portions 7 of exposed copper-wire bundles of the speaker cables 5 to be wound thereon. To ensure the connection, screw bases 8 are provided for each of the input terminals of the speaker units in order to secure the wound-up tip portions 7 of copper-wire-bundles onto the corresponding output terminals.

FIG. 13 exemplifies such a state in which tip portions 7 of exposed copper-wire bundles of the speaker cables 5 are pinched into the corresponding audio output terminals of an electronic apparatus. When executing such method, audio output terminals of an electronic apparatus and corresponding input terminals of each speaker unit are provided with such a structure which causes the tip portions 7 of exposed copper-wire-bundles of speaker cables 5 inserted in through-holes 9 to be pinched by means of metallic spring members functioning as elastically-displaceable terminals for example.

Conventionally, as shown in FIG. 12 or 13, independent of actually arranged positions of speaker units linked with a number of audio signal output terminals, multi-channel audio signal output terminals of an electronic apparatus comprise the one usable for the left and right channels in the front position, the one usable for the left and right channels in the rear position, and yet, also comprise those output terminals solely usable for the center channel and the one solely usable for bass-output channel which are respectively disposed at optional positions.

Nevertheless, as described above, in the case of such a multi-channel audio system corresponding to a home theater system, identical connecting materials, i.e., identical speaker cables, are used even with a plurality of speaker units to be connected. Because of this, connection between the speaker cables and the linking channels can hardly be discerned.

To deal with this problem, it has been a conventional practice to implement such a process, in which, before installing speaker units, speaker units and an electronic apparatus are disposed to be close to each other, and then, while confirming mutual channel relationship, speaker units are connected to the electronic apparatus, and finally, speaker units are respectively installed at specific positions. Further, there has been another method in which, after setting speaker units at specific positions, speaker cables connected to speaker units or to the electronic apparatus are pulled in the direction of the speaker units or the electronic apparatus before eventually connecting the speaker cables to the output terminals of the speaker units or to the output terminals of the electronic apparatus.

Nevertheless, when implementing either of the above methods, inasmuch as it is quite necessary to check and confirm the connecting relationship between individual speaker cables and the corresponding channels, it constitutes an extremely troublesome routine. Because of this, speaker cables were connected to wrong channels.

Further, in order to discern the positive and negative polarities, sheathing member 6 for sheathing copper-wire-bundles of speaker cables is coated with a variety of colors. However, inasmuch as it is optional for individual users to connect copper wires covered with a sheath 6 coated with a specific color to either of both polarities, there has been such a fear of inverting the positive and negative polarities in the connection between the speaker cables 5 and audio signal output terminals of an electronic apparatus and also such a fear of inverting the positive and negative polarities in the connection between the speaker cables 5 and output terminals of the connected speaker units.

Further, as described above, inasmuch as audio signal output terminals of any of conventional electronic apparatuses have not been devised to properly deal with actually disposed positions of individual speaker units per channel, when a plurality of speaker cables 5 are led out from audio signal output terminals in correspondence with the actually disposed positions of individual speaker units, these plural speaker cables 5 cross each other, making it difficult to properly discern the connecting relationship between individual speaker cables 5 and the corresponding output terminals per channel, thus causing confusion to the setting operator when actually connecting individual speaker cables to the output terminals of corresponding speaker units per channel.

For example, as shown in FIG. 12 and 13, in such a case in which audio signal output terminals provided for the front-left-right channels are disposed to the left of an electronic apparatus whereas audio signal output terminals provided for the rear-left-right channels are disposed to the right thereof, assume that speaker cables each being connected to the audio signal output terminals of this electronic apparatus are led out in correspondence with actually disposed positions of speaker units per channel, then, as shown in FIG. 14, speaker cables 5FL connected to speaker units provided for the front-left channel are led from the electronic apparatus across the audio signal output terminals provided for the rear-left-right channels. On the other hand, speaker cables 5RR connected to speaker units provided for the rear-left-right channels are led from the electronic apparatus across the audio signal output terminals provided for the front-left-right channels, whereby causing these two sets of speaker cables to intersect themselves to make it difficult to have them properly aligned with each other.

Yet, as is apparent from an intersecting portion 7*c* shown in FIG. 14, when tip portions 7 of copper-wire-bundles of respective speaker cables 5 are brought into contact with each other in short-circuit, then, a resultant failure will be caused to the connected electronic apparatus.

Viewing from the front of an electronic apparatus, speaker cables 5FR connected to audio signal output terminals provided for the front-right channel and the other speaker cables 5RR connected to audio signal output terminals provided for the rear-right channel are respectively led from the right-side of the electronic apparatus. However, inasmuch as these speaker cables are exactly identical to each other, while these speaker cables are led to the corresponding speakers per channel, they are subject to intersection with each other, thus confusing setting operator to properly connect individual speaker cables to the corresponding speaker units. This confusion will also be caused when connecting speaker cables to the corresponding speaker units provided for the front-left channel, the rear-right channel, and the center channel as well.

Further, as described above, inasmuch as audio signal output terminals of any of conventional electronic apparatuses have not been devised to properly deal with actually disposed positions of individual speaker units per channel, as shown in FIGS. 12, 13, and 14, even though names of respective channels are shown on the back-panel surface of the electronic apparatus provided with audio signal output terminals, if the setting operator or user is not well versed in the multi-channel audio system, it is feared that the operator becomes confused when determining proper positions for installing speaker units connected to audio signal output terminals per channel.

Further, in the case of applying the multi-channel audio system to a specific purpose such as a home theater system, even when using a plurality of speaker units of the identical kind for multi-channels, in order that acoustics can properly be reproduced in the best acoustic environment, manufacturer of the multi-channel audio system may deliver the whole system by way of adjusting speaker units per channel specifically for the front-left-right channels, the rear-left-right channels, the center channel, and for the bass-output channel, for example.

Nevertheless, as mentioned above, conventionally, there are many cases in which connecting relationship of individual speaker units against corresponding channels is not designated, or even when being designated, the connecting relationship can hardly be discerned, thus causing the setting operator or user to connect such speaker units different from proper channels designed by the manufacturer. This in turn causes intended acoustics to be output improperly from speaker units disposed at proper positions to result in the failure to precisely reproduce original media-source. If it turns out to be so, inasmuch as original media-source can hardly be reproduced with high-fidelity, it is feared that the purchaser of the multi-channel audio system will fail to fully enjoy original acoustic effect intended by the manufacturer.

In order to assuredly reproduce such a high-fidelity acoustic environment, it is quite necessary to check and confirm individual audio signal output terminals of an electronic apparatus per channel and speaker units of the corresponding channels, and yet, it is also necessary to check and confirm the positive-side terminals and the negative-side terminals. Further, connecting operation must be performed with sufficient care not to cause each speaker cable to be short-circuited with adjoining terminals by way of checking and confirming proper positions for disposing individual speaker units. This in turn incurs extreme annoyance and much time to be spent for implementing the whole connecting routines.

SUMMARY OF THE INVENTION

An object of the present invention is to fully solve the above problems by way of providing means for easily and discernibly connecting individual speaker units to an electronic apparatus fitted with audio signal output terminals independently of the number of audio signal output channels.

In order to fully solve the above problems, such a multi-channel audio system according to an embodiment 1 of the present invention comprises the following:

an electronic apparatus fitted with audio signal output terminals of more than four of plural channels;

a plurality of speakers for generating acoustic output per channel via audio signal from individual audio signal output terminals provided for the plural channels; and connecting cable members each incorporating two pieces of conductors with a pair of inverse polarities sheathed by an insulating sheathing member for connecting the electronic apparatus to the plural speakers;

wherein the individual audio signal output terminals provided for the plural channels of such electronic apparatus are disposed in correspondence with disposed positions of the plural speakers aligned in correspondence with the plural channels.

According to such embodiment of the present invention, inasmuch as audio signal output terminals of the electronic apparatus are respectively disposed in correspondence with disposed positions of multi-channel speakers, connecting cable members provided for plural channels are properly aligned without intersection at the audio signal output terminals.

Because of easy matching between disposed speakers and audio signal output terminals in the course of connecting an electronic apparatus to a plurality of speakers via connecting cable members, connecting operation can readily be implemented.

Still, another embodiment 2 of the present invention is characterized by provision of the following:

an electronic apparatus fitted with audio signal output terminals provided for more than four of plural channels;

a plurality of speakers for generating acoustic output for individual channels by means of audio signals delivered from individual audio signal output terminals provided for the plural channels; and connecting cable members each incorporating two pieces of conductors with a pair of inverse polarities sheathed by an insulating sheathing member for connecting the electronic apparatus to the plural speakers; wherein audio signal output terminals provided for the plural channels of the electronic apparatus enable each of individual channels to be discernibly identified by means of coating with different colors; and the connecting cable members are coated with different colors per channel of the audio signal output terminals.

According to an embodiment 3 of the present invention, each of individual channels can discernibly be identified by means of different colors coated on audio signal output terminals of a plurality of channels and on the connecting cable members. Accordingly, by way of using terminals and connecting cable members each bearing different colors corresponding to individual channels, it is possible to easily and correctly implement connection of the connecting cable members between audio signal output terminal terminals and speakers disposed at specific positions per channel.

Still, an embodiment 4 of the present invention related to a multi-channel audio system is characterized by provision of coloring applied to individual terminals of the plural speakers in correspondence with colors coated on individual audio signal output terminals per channel.

According to such embodiment 4 of the present invention, inasmuch as terminals of individual speakers are coated with specific colors corresponding to a variety of colors applied to audio signal output terminals and connecting cable members per channel for discerning purpose, it is possible to readily and correctly implement connection between audio signal output terminals and individual speakers, whereby making it possible to readily and assuredly reproduce original acoustic environment intended by the system manufacturer.

The embodiment 4 of the present invention related to a multi-channel audio system is characterized by adhesion of plural labels which respectively designate names of channels and bear different colors corresponding to colors provided per channel, wherein the colored labels are adhered to locations close to individual speaker terminals for discerning purpose.

According to such embodiment 4 the present invention, inasmuch as a plurality of labels each bearing different color are merely disposed to locations close to individual speaker terminals for discerning purpose without varying structure of the terminals, it in turn leads to cost saving.

Still, an embodiment 5 of the present invention related to a multi-channel audio system is characterized by provision of a plurality of sheets which are individually adhered to locations close to individual audio signal output terminals and coated with different colors per channel in order to discernibly identify individual audio signal output terminals by means of different colors.

According to such embodiment 5 of the present invention, inasmuch as colored sheets are discernibly used for identifying individual audio signal output terminals instead of using colored audio signal output terminals, it is possible to save cost.

In addition, an embodiment 6 of the present invention related to a multi-channel audio system further provides the following:

at least one end of each of the connecting cable members conforms to structure of a first connector member incorporating a pair of conductor members individually being connected with the two pieces of conductors;

each of the audio signal output terminals provided for the electronic apparatus conforms to structure of a second connector member coupled with the first connector member;

either of the first connector member and the second connector member incorporates two pieces of connecting pins each bearing a pair of inverse polarities and a position controlling member used for matching polarities when coupling the other connector member therewith; and the other connector member of either the first connector member or the second connector member incorporates a pair of coupling holes for coupling with the two pieces of connecting pins each bearing a pair of inverse polarities and a position-controlling-member-coupling member for coupling with the polarity-matching position controlling member; wherein color used for distinction of the connecting cable members corresponds to that is used for the first connector member.

According to such embodiment 6 of the present invention, solely in the state in which polarities of connectors of connecting cable members are coincident with each other due to presence of the polarity-matching position controlling member, connectors of the connecting cable members can be coupled with connector members of audio signal output terminals. Accordingly, not only is it possible to easily and correctly implement connection between audio signal output terminals and speakers per channel via color wise distinction, but it is also possible to easily match both polarities via the audio signal output terminals and speakers.

BRIEF DESCRIPTION OF THE DRAWINGS

The above and other objects, features and advantages of the present invention will become more apparent from the following description of the presently preferred exemplary embodiments of the invention taken in conjunction with the accompanying drawings, in which.

DESCRIPTION OF THE PREFERRED EMBODIMENTS

Referring to the accompanying drawings, practical forms for implementing the present invention are described below.

A practical form for implementing the present invention described below represents a case in which the inventive art is applied to a home theater system shown in FIG. 10. As mentioned earlier, the inventive art is applied to a six-channel audio system consisting of two of front channels, two of rear channels, a bass-output-only (woofer) channel, and a center channel. Likewise, as mentioned earlier, the inventive art is applied to a digital versatile disc (DVD) player as an electronic apparatus fitted with a plurality of audio signal output terminals.

Figure 1:
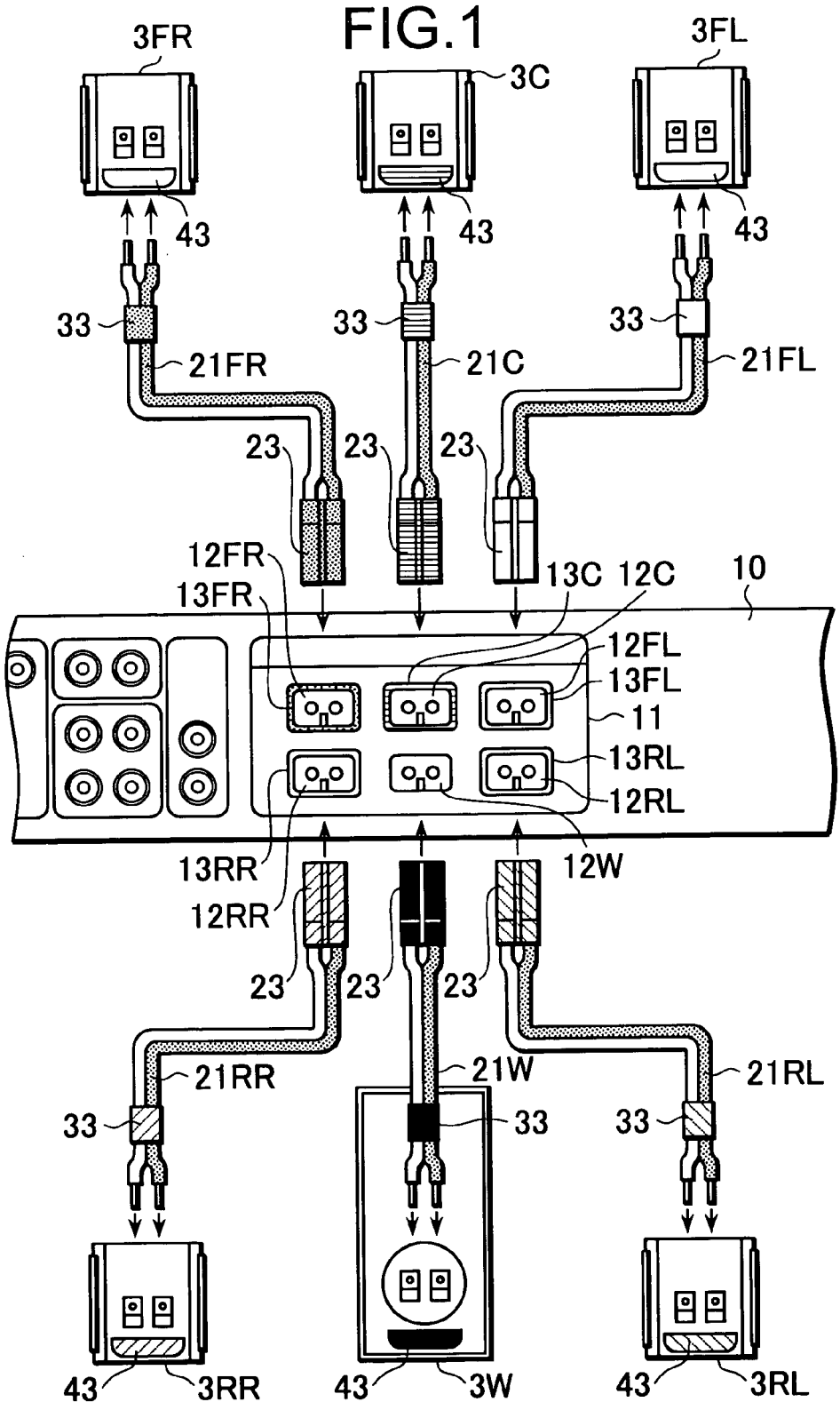
FIG. 1 is an overall schematic block diagram explanatory of the whole construction of a multi-channel audio system according to an embodiment of the present invention.
Figure 10:
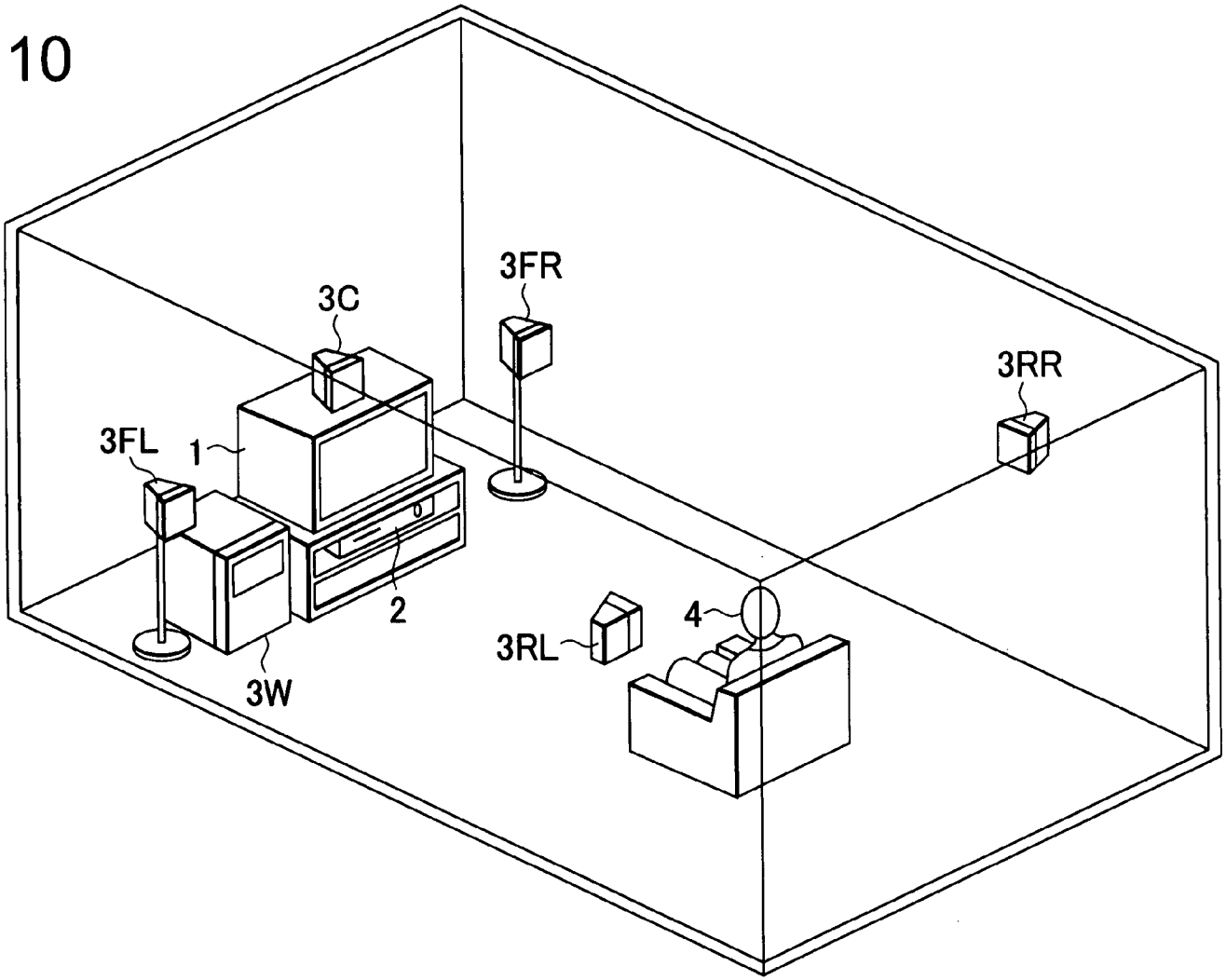
FIG. 10 is a schematic diagram explanatory of an overall aspect of a multi-channel audio system.

FIG. 1 is an overall schematic block diagram explanatory of the connection between a DVD player 10 as an electronic apparatus fitted with a plurality of audio signal output terminals according to an embodiment of the present invention and a plurality of speakers including 3FR, 3FL, 3RR, 3RL, 3C, and 3W, respectively being disposed as shown in FIG. 10.

As shown in FIG. 1, the back panel of the DVD player 10 is fitted with an audio signal output terminal accommodating portion 11 compatible with six channels. In this embodiment, as shown in FIG. 2 being an enlarged view thereof, audio signal output terminals corresponding to six channels including six units (channels) of plug-in-system sockets 12FR, 12FL, 12RR, 12RL, 12C, and 12W.

The socket 12FR constitutes an output terminal for the front-right-channel audio signal. The socket 12FL constitutes an output terminal for the front-left-channel audio signal. The socket 12RR constitutes an output terminal for the rear-right-channel audio signal. The socket 12RL constitutes an output terminal for the rear-left-channel audio signal. The socket 12C constitutes an output terminal for the center-channel audio signal. The socket 12W constitutes an output terminal for the bass-only channel audio signal.

These six sockets including 12FR, 12FL, 12RR, 12RL, 12C, and 12W, are formed in the upper and lower ranks three by three. In such embodiment, as shown in FIGS. 1 and 2, such six speakers 12FR, 12FL, 12RR, 12RL, 12C, and 12W, are respectively disposed in correspondence with the positions arranged for disposing them. FIGS. 1 and 2 respectively designate a view of the above-referred audio signal output terminal accommodating portion 11 seen from the back-panel side, and thus, the left and right relationship of this view is reversed from what is seen from the listener side.

Figure 2:
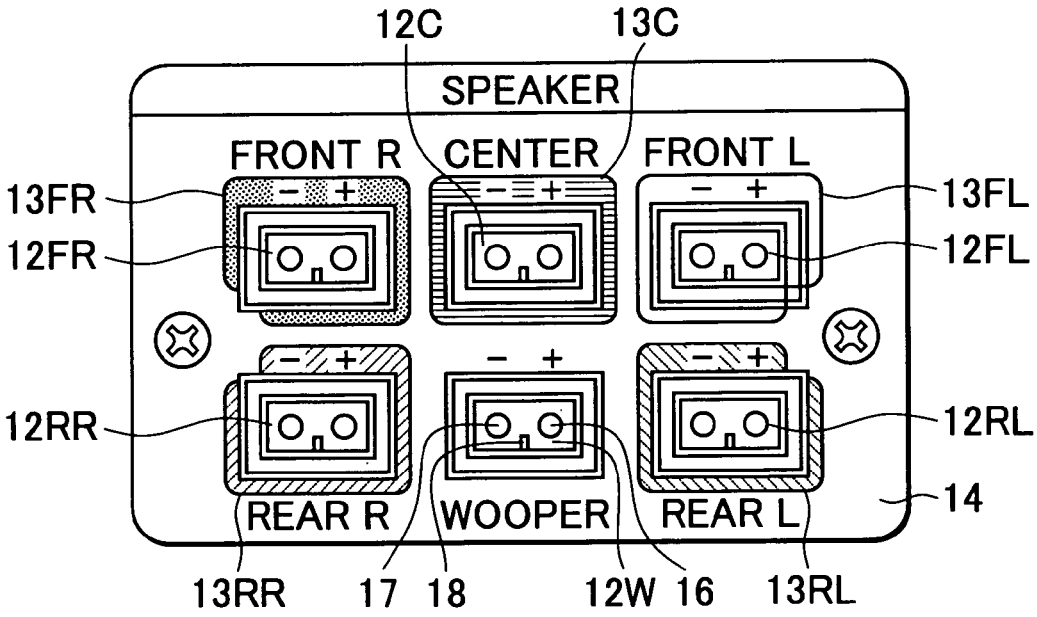
FIG. 2 is a diagram exemplifying a construction of a rear panel fitted with audio signal output terminals of an electronic apparatus according to a an embodiment of the present invention.

In other words, as shown in FIG. 2, the front-right-channel socket 12FR and the rear-right-channel socket 12RR are disposed in the upper and lower ranks on the left side of the audio signal output terminal accommodating portion 11. On the other hand, the front-left-channel socket 12FR and the rear-left-channel socket 12RR are disposed in the upper and lower ranks on the right side of the audio signal output terminal accommodating portion 11. The center-channel socket 12C is disposed at the center position of the portion 11. The bass-only channel socket 12W is disposed below the center position of the portion 11.

In addition, the upper and lower relationship of the front-channel sockets and the rear-channel sockets may be reversed.

As described above, inasmuch as those sockets provided for respective output channels are disposed in correspondence with actually disposed positions of individual speakers per channel, when connecting a plurality of sockets including 12FR, 12FL, 12RR, 12RL, 12C, and 12W, are respectively connected to a plurality of speakers 3FR, 3FL, 3RR, 3RL, 3C, and 3W usable for respective output channels via a plurality of connecting cable members 21FR, 12FL, 21RR, 21RL, 21C, and 21W, these connecting cable members are free from mutually being entangled in all directions.

In other words, for example, the connecting cable member 21FR provided for the front-right-channel and the other connecting cable member 21RR provided for the rear-right-channel are respectively led to the right as viewed from the front of the DVD player 10 without crossing audio signal output terminal portions used for other channels. On the other hand, the connecting cable member 21FL provided for the front-left-channel and the other connecting cable member 21RL provided for the rear-left-channel are respectively led to the left as viewed from the front of the DVD player 10 without crossing audio signal output terminal portions used for other channels. In consequence, the connecting cable members provided for the left and right channels can be prevented from intersecting with each other.

Further, when guiding the connecting cable member 21C provided for the center channel and the other connecting cable member 21W provided for the bass-only channel from the DVD player 10 in correspondence with the speaker setting positions shown in FIG. 10, these connecting cable members 21C and 21W are individually led to the upper side and the lower side of the DVD player 10 without causing them to intersect other connecting cable members.

In this embodiment, individual audio signal output channels provided for six channels are discretely distinguished per color, whereby enabling connecting relationship between the DVD player 10, speakers, and connecting cable members to be to be integrally discernible to enable setting operator to easily and correctly follow up connection routines.

In this embodiment, for example, distinction per color is implemented as shown below.

| | |
|---|---|
| Front-right channel | Red |
| Front-left channel | White |
| Rear-right channel | Yellow |
| Rear-left channel | Blue |
| Center channel | Green |
| Bass-only channel | Black |

In this embodiment, output terminals of individual output channels provided for the DVD player 10 can mutually be identified by way of discerning them per color. In other words, as shown in FIG. 2, sheets 13FR, 13FL, 13RR, 13RL, and 13C, coated with the above-cited colors are adhered to peripheral portions of socket-fixed areas per channel on the back-panel 14 of the DVD player 10. In this example shown in FIG. 2, positive and negative polarities of conductors per output channel are printed on the sheets 13FR, 13FL, 13RR, 13RL, and 13C for visual identification.

In the example shown in FIG. 2, no color sheet is attached to a socket 12W usable for the bass-only channel. In this example, it is determined that the bass-only channel is distinguished by means of black color, and yet, inasmuch as the back-panel 14 itself bears black color, adhesion of a black sheet is omitted. However, if different colors are allocated to the back-panel 14 and the bass-only channel, such a color sheet for visual discernment will also be provided for the socket 12W usable for the bass-only channel.

In order to enable user to discern concrete relationship between those sockets 12FR, 12FL, 12RR, 12RL, 12C, and 12W, and corresponding output channels, as shown in FIG. 2, names of individual output channels are previously printed in the vicinity of the sockets corresponding to individual channels on the back-panel 14. However, instead of printing names of those output channels on the back-panel 14, it is also allowable to print names of those output channels on the sheets 13FR, 13FL, 13RR, 13RL, 13C, and 13W (for bass-only channel) usable for channel discernment per color.

It is also possible to arrange component parts of the sockets 12FR, 12FL, 12RR, 12RL, 12C, and 12W to be coated with predetermined colors corresponding to individual channels. Nevertheless, this in turn requires provision of six-color sockets to result in the increased cost. On the other hand, as in the case of this embodiment, utilization of the sheets 13FR, 13FL, 13RR, 13RL, 13C, and 13W each bearing different colors advantageously leads to cost reduction.

In addition, instead of adhering those sheets for discerning individual channels per color onto the back-panel 14, it is also allowable to previously form the sheet-adhering portion with printed six colors on the back-panel 14.

Next, a practical form for connecting audio signal output terminals to connecting cable members and a method of distinction of the connecting cable members via coloration are described below.

In this practical form for implementing the present invention, unlike the conventional winding and pitching methods, a plug-in method is introduced to implement connection between audio signal output terminals of an electronic apparatus and corresponding connecting cable members. In other words, in this embodiment, the above-described sockets are provided on the part of the audio signal output terminals, whereas one end of the connecting cable members 21FR, 21FL, 21RR, 21RL, 21C, and 21W is provided with a plug to be coupled with the corresponding socket.

Figure 3:
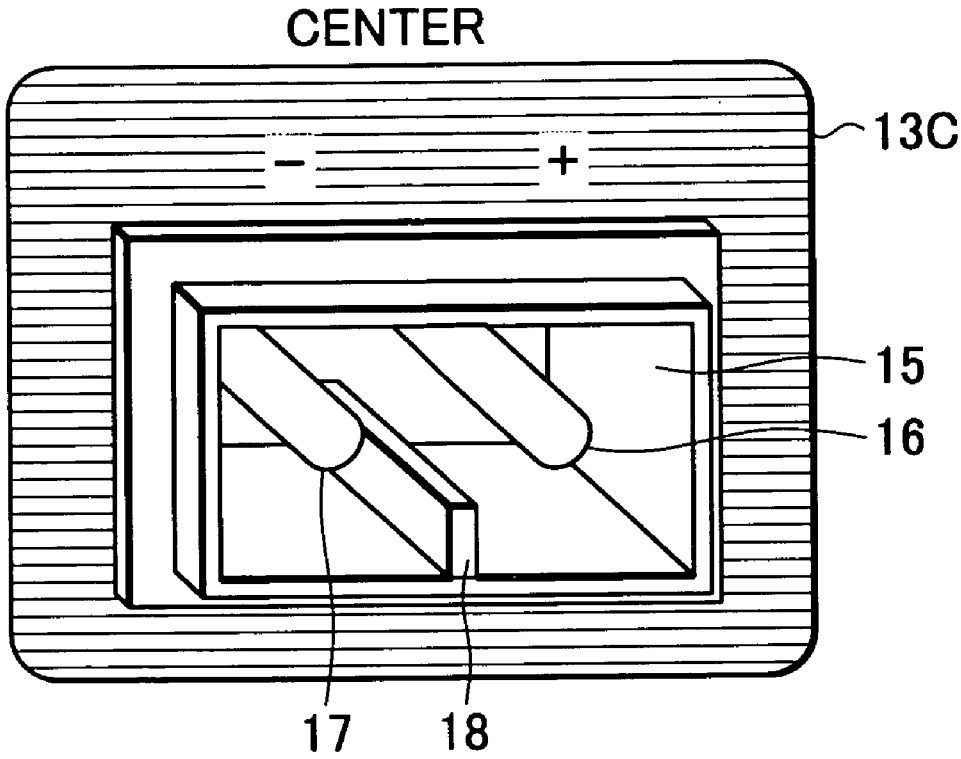
FIG. 3 is a schematic diagram explanatory of one constituent of the component shown in FIG. 2.

As shown in FIG. 3, the sockets 12FR, 12FL, 12RR, 12RL, 12C, and 12W respectively functioning as the six-channel audio signal output terminals of the above-referred DVD player 10 are individually provided with a recess portion 15 for allowing coupling with corresponding plugs on the part of the connecting cable members to be described later on. Each of the recess portions 15 accommodates a pair of horizontally aligned conductor pins 16 and 17 each being linked with a positive-side conductor and a negative-side conductor of individual audio signal output terminals by way of projecting themselves from the bottom of the recessed portion 15.

Further, a rib member 18 functioning itself as a position controlling member is installed on a bottom lateral surface of the recess portion 15, where the rib member 18 prevents a plug on the part of a corresponding connecting cable member (to be described later on) from inadequately being inserted into the socket body by way of inverting the positive and negative polarities. The rib member 18 is disposed at a position corresponding to the center position between a pair of conductor pins 16 and 17.

Figure 4:
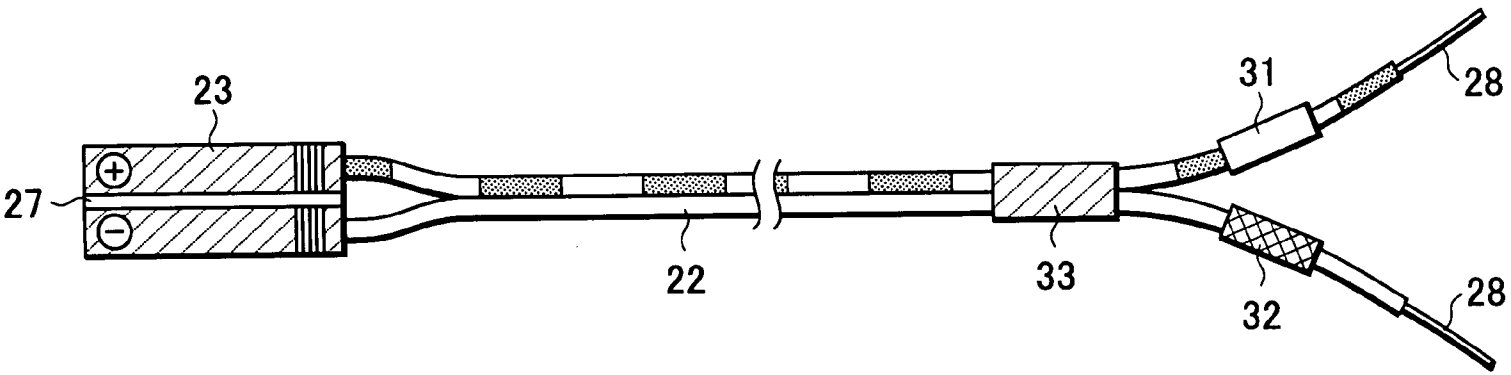
FIG. 4 is a schematic diagram exemplifying a construction of a connecting cable member according to an embodiment of the present invention.

On the other hand, as shown in FIG. 4, like the conventional practice, the connecting cable members 21FR, 21FL, 21RR, 21RL, 21C, and 21W are individually composed of a pair of bundles each comprising a number of fine copper wires for constituting a connecting cable member 22, which is fully sheathed with a sheathing member made from polyvinyl chloride (PVC) for example. Each connecting cable member comprises a pair of copper-wire-bundles which are integrated inside of the sheathed portion. As shown in FIG. 4, in this example, in order to visually discern the positive and negative polarities, each of sheathing members for sheathing the cable member 22 is coated with a different color as in the conventional practice at the portion corresponding to each of the two copper-wire-bundles. Nevertheless, in this practical form for implementing the present invention, distinction of the sheathing members for sheathing the connecting cable members 22 via coloration is not essentially required.

Figure 11A:
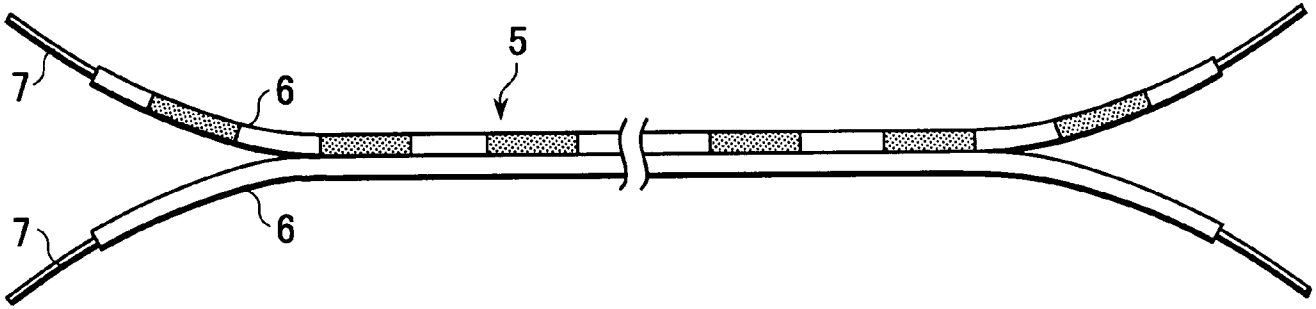
FIG. 11(A) and (B) are schematic diagrams explanatory of a construction of a pair of conventional connecting cable members.
Figure 11B:
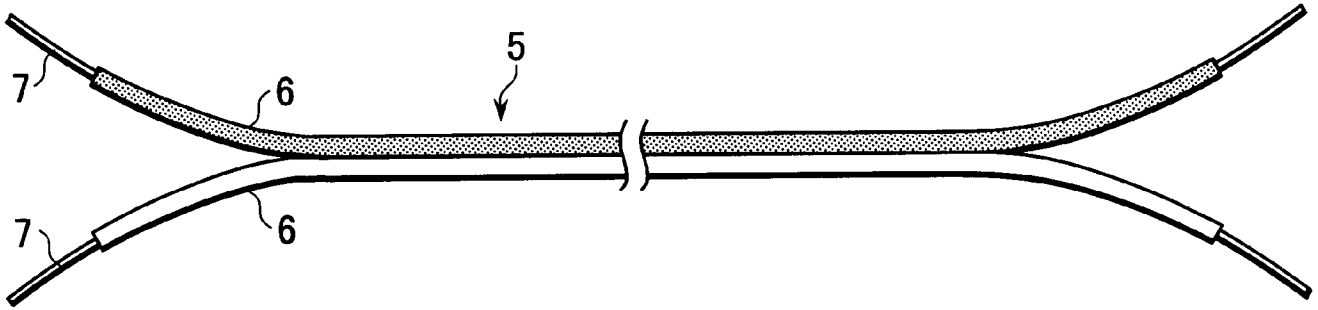
Figure 12:
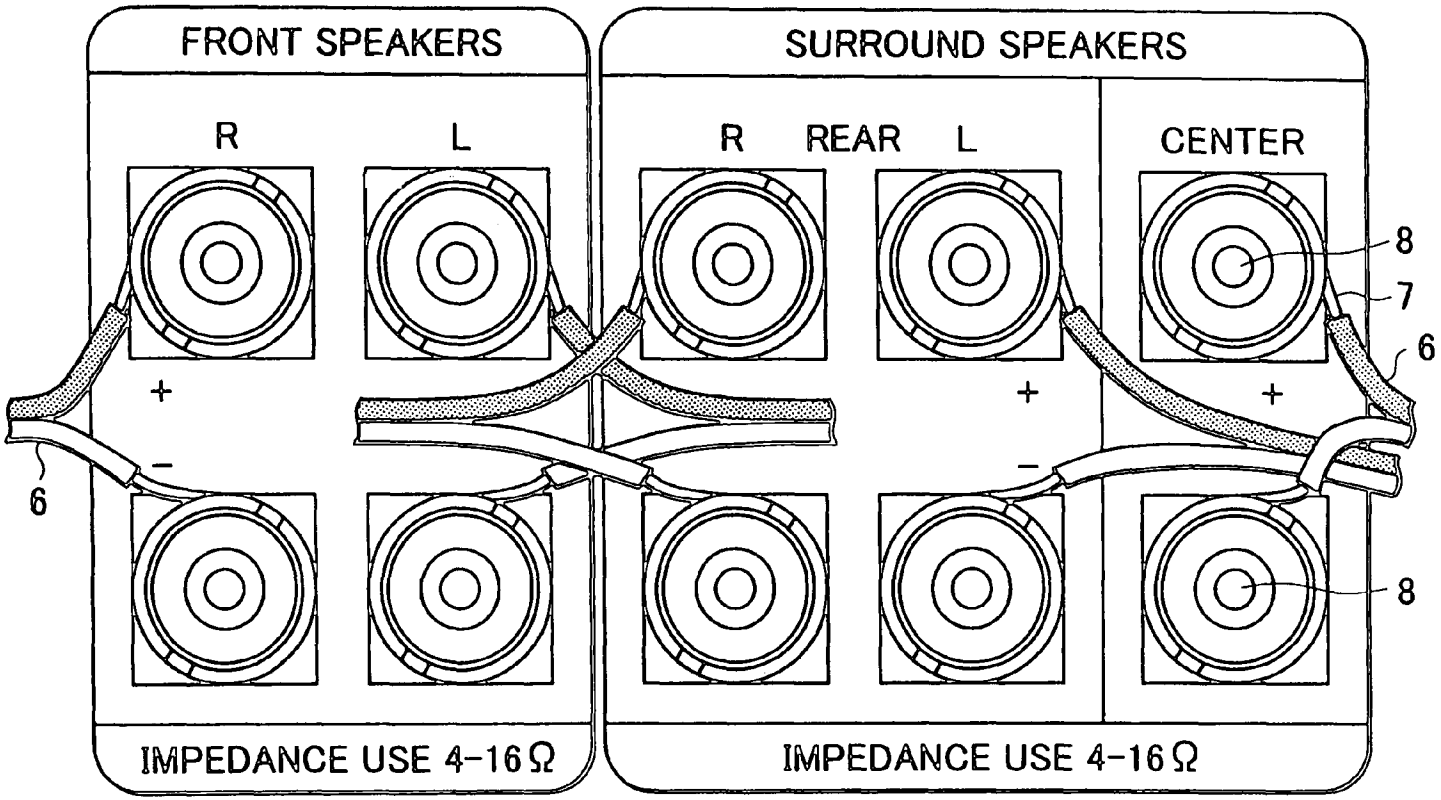
FIG. 12 is a schematic diagram of audio signal output terminals connected to conventional connecting cable members explanatory of an aspect of a conventional connection system.
Figure 13:
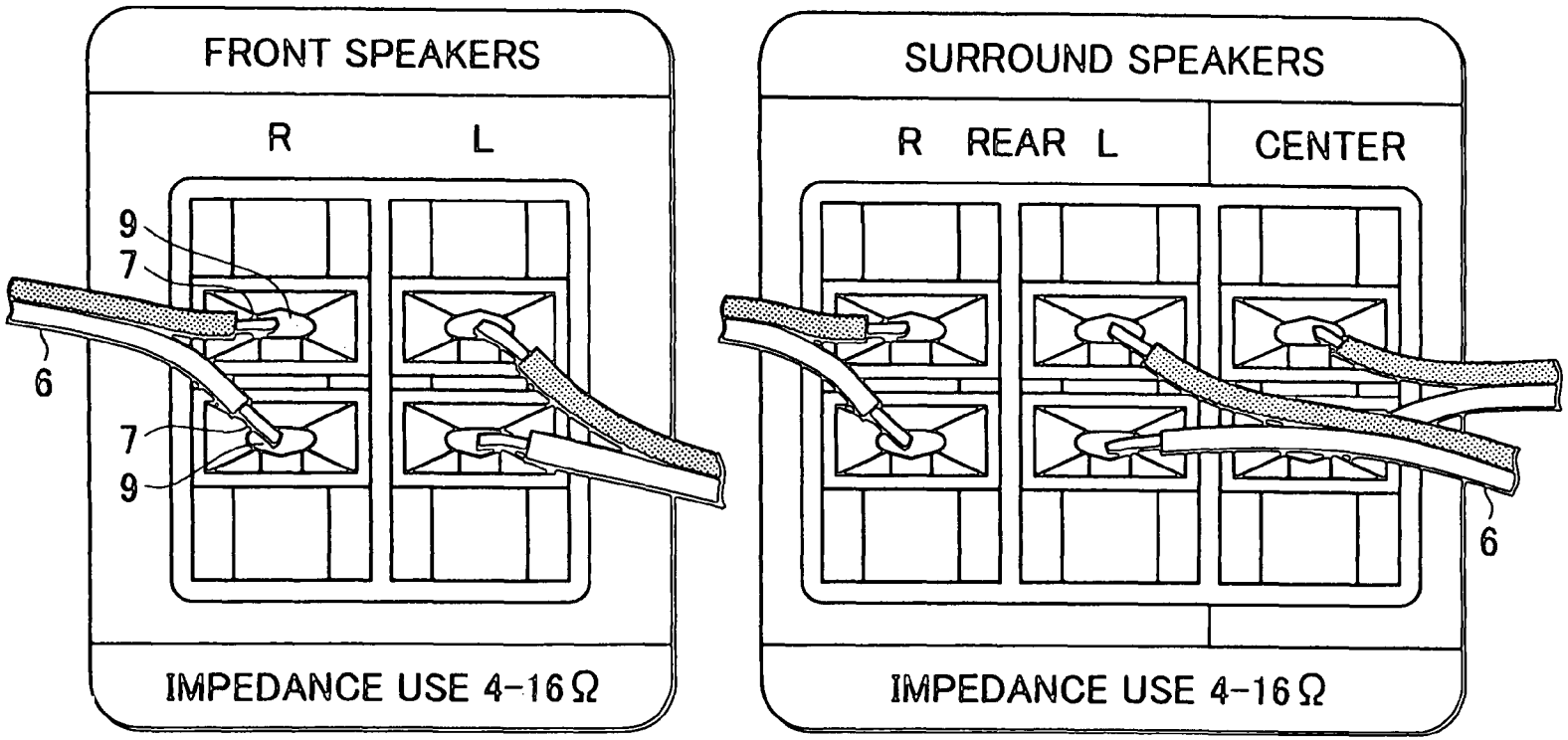
FIG. 13 is explanatory of another conventional connecting system between audio signal output terminals and conventional connecting cable members.
Figure 14:
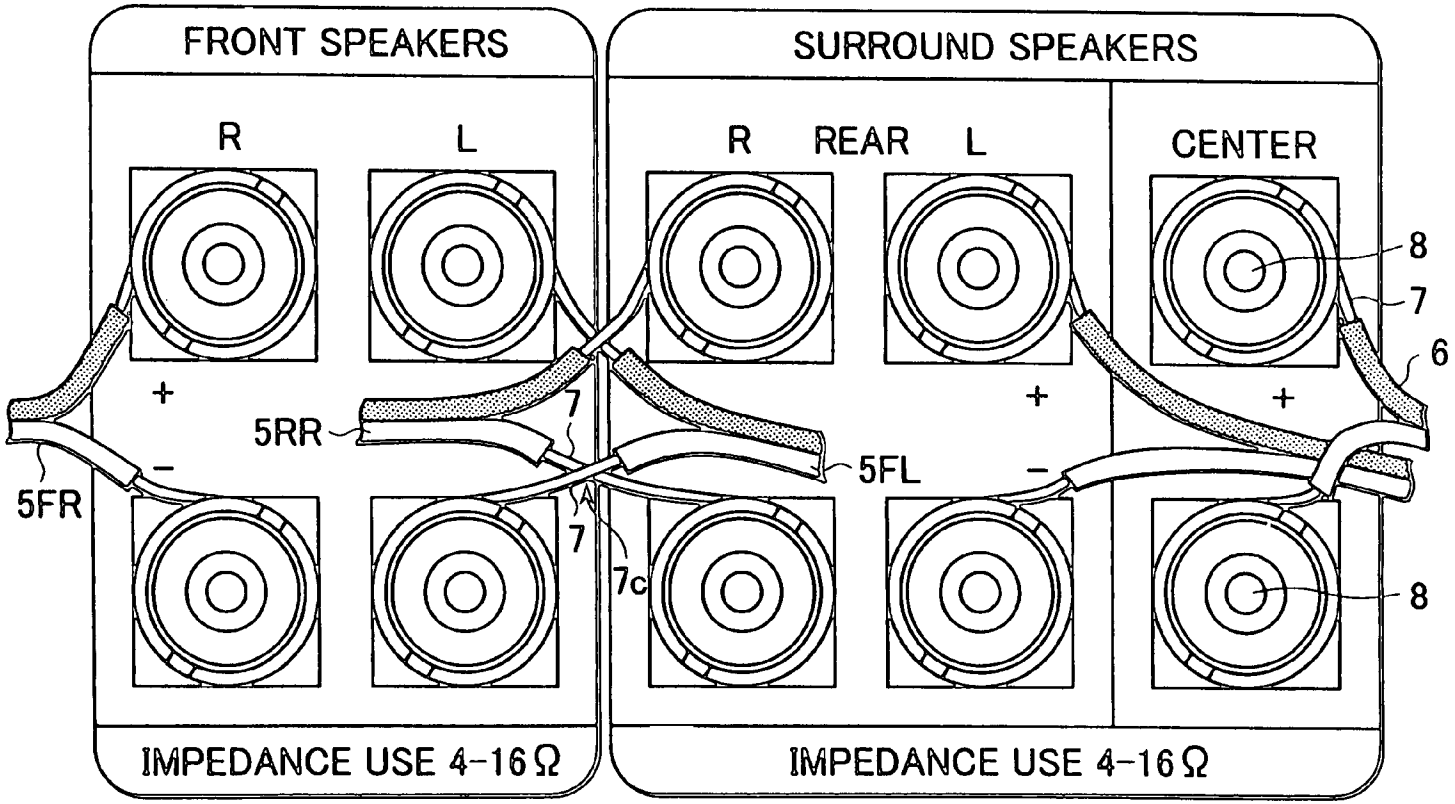
FIG. 14 is a schematic diagram explanatory of an improper connection between audio signal output terminals and conventional connecting cable members.

In addition, as shown in FIG. 11(A) and (B), two of the sheathed portions are split from each other at both ends of the connecting cable member 22, and then, the sheathing member at the tip of the split portion is stripped off to cause a pair of copper-wire-bundles to be exposed. Nevertheless, one respective end of the connecting cable members 21FR, 21FL, 21RR, 21RL, 21C, and 21W, constitutes a plug 23 to be coupled with one of the above-referred sockets, and yet, a pair of copper-wire-bundles are individually connected to a pair of conductors accommodated in each socket. A specific color applied to the plug 23 corresponds to a color compatible with individual audio signal output terminals.

Except for coloration effect, construction of individual plugs 23 is exactly identical to those which are provided for the connecting cable members 21FR, 21FL, 21RR, 21RL, 21C, and 21W.

Figure 5:
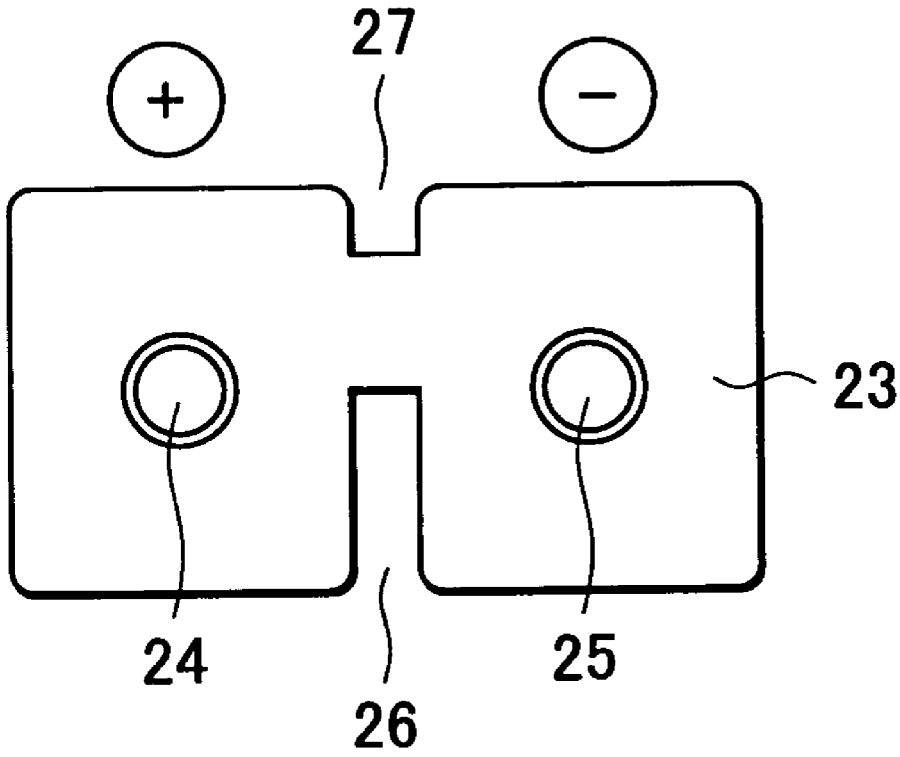
FIG. 5 is a schematic diagram explanatory of one constituent of the component shown in FIG. 4.

In this embodiment, as shown in FIG. 5 viewed from the tip portion of the plug 23, each plug 23 comprises a pair of jack-hole portions 24 and 25 to be coupled with the conductor pins 16 and 17 of each of the above-referred sockets. Each of the jack-holes 24 and 25 incorporates a pair of conductors each bearing the positive and negative polarities and electrically being connected to the conductor pins 16 and 17. The positive and negative tip portions of copper-wire-bundles for constituting the connecting cable member 22 are respectively connected to conductor elements of the jack-hole portions 24 and 25 via a soldering process.

After implementing connection between the positive and negative tip portions of copper-wire-bundles of the connecting cable member 22 and the above-referred conductor elements via a soldering process, the plug 23 itself is formed by a plastic molding process. As is clear from FIG. 5, the plug 23 is integrated without being split into a discrete positive conductor and a discrete negative conductor.

In this embodiment, by way of distinguishing colored plastic portions of the plug 23 per color in correspondence with individual output channels, individual plugs 23 are used for connecting individual cable members to audio signal output terminals of a DVD player 10 based on the color wise distinction specified below:

- A red plug 23 is provided for the front-right-channel connecting cable member 21FR;
- A white plug 23 is provided for the front-left-channel connecting cable member 21FL;
- A yellow plug 23 is provided for the rear-right-channel connecting cable member 21RR;
- A blue plug 23 is provided for the rear-left-channel connecting cable member 21RL;
- A green plug 23 is provided for the center-channel connecting cable member 21C; and
- A black plug 23 is provided for the bass-only channel connecting cable member 21W.

In the examples shown in FIG. 4 and FIG. 5, the positive and negative polarities are previously determined for a pair of copper-wire-bundles of the connecting cable member 22. Accordingly, as shown in FIG. 4, the predetermined positive and negative polarities are respectively designated by means of hallmarks. In the practical form for implementing the present invention, it is so devised that the positive and negative polarities of the plug 23 and sockets can correctly be connected to each other by means of the above-referred rib member 18 provided for each socket.

In other words, in the example shown in FIG. 5, a pair of slits 26 and 27 are disposed at the upper and lower portions of the plug 23 in the thickness direction thereof at the position sectioning a pair of positive and negative copper-wire bundles. It is so devised that, by way of varying depth of the slits 26 and 27, the plug 23 can be prevented from being inserted into the corresponding socket as of the state with inversion of the positive and negative polarities.

In such embodiment of the present invention, the lower slit 26 of the plug 23 is provided with such a depth enough to allow insertion of the rib member 18 of the corresponding socket therein. On the other hand, the upper slit 27 is provided with such a depth that does not allow insertion of the rib member 18 of the corresponding socket by way of causing the rib member 18 to collide with the plug 23.

Accordingly, in the example shown in FIG. 5, the positive and negative polarities are designated above the plug 23. This enables the setting operator to insert the plug 23 into the corresponding socket by holding the polarity-designated portion upside. When the plug 23 has been inserted, the positive and negative polarities designated on the plug 23 correctly match the positive and negative polarities of the corresponding socket.

On the other hand, when the upper and lower sides of the plug 23 are inverted, the rib member 18 prevents the plug 23 from entering into the corresponding socket. Accordingly, setting operator is prevented from inserting the plug 23 into the corresponding socket by way of inverting the positive and negative polarities.

Next, a method of executing connection between the connecting cable members 21FR, 21FL, 21RR, 21RL, 21C, and 21W, and the speakers 3FR, 3FL, 3RR, 3RL, 3C, and 3W provided for corresponding output channels is described below.

In this embodiment, based on the conventional sandwiching method cited earlier, the connecting cable members 21FR, 21FL, 21RR, 21RL, 21C, and 21W are individually connected to the corresponding speakers 3FR, 3FL, 3RR, 3RL, 3C, and 3W. However, in this embodiment of the present invention, in order to facilitate connecting routine, individual speakers are previously specified per output channel, and yet, individual output channels are distinguished to be visually discernible per color.

More particularly, as shown in FIG. 4, like in the conventional practice, two of the sheathed portions at one end of individual speakers 21FR, 21FL, 21RR, 21RL, 21C, and 21W to be connected to the corresponding speakers 3FR, 3FL, 3RR, 3RL, 3C, and 3W, are split from each other, and yet, sheathing members at the tip of the split portions are respectively stripped off to expose copper-wire-bundles. As a result, tip portions 28 of the exposed copper-wire-bundles are connected to terminals of corresponding speakers.

In this embodiment of the present invention, as described above, one end of the connecting cable members is respectively formed with a plug 23 shown in FIG. 4 and FIG. 5, where arrangement of the positive and negative polarities is uniformly defined. In order to clarify the positive and negative polarities of two of the sheathed portions being split from each other, for example, a thermally contractile white tube 31 is secured to one end of each of connecting cable members connected to speaker terminals on the part of the positive polarity of the plug 23, whereas a thermally contractile black tube 32 is secured to one end of connecting cable members connected to speaker terminals on the part of the negative polarity of the plug 23.

Further, in order to discern the connecting relationship between individual connecting cable members and audio signal output channels, a thermally contractile tube 33 coated with a specific color provided for a corresponding output channel is secured to a portion at which two of the sheathed portions of individual connecting cable members 22 are integrated.

On the other hand, labels each bearing the printed name of a corresponding output channel and both polarities and a specific color corresponding to the output channel are adhered to the vicinity of terminals of individual speakers 3FR, 3FL, 3RR, 3RL, 3C, and 3W connected to respective output channels.

Figure 6:
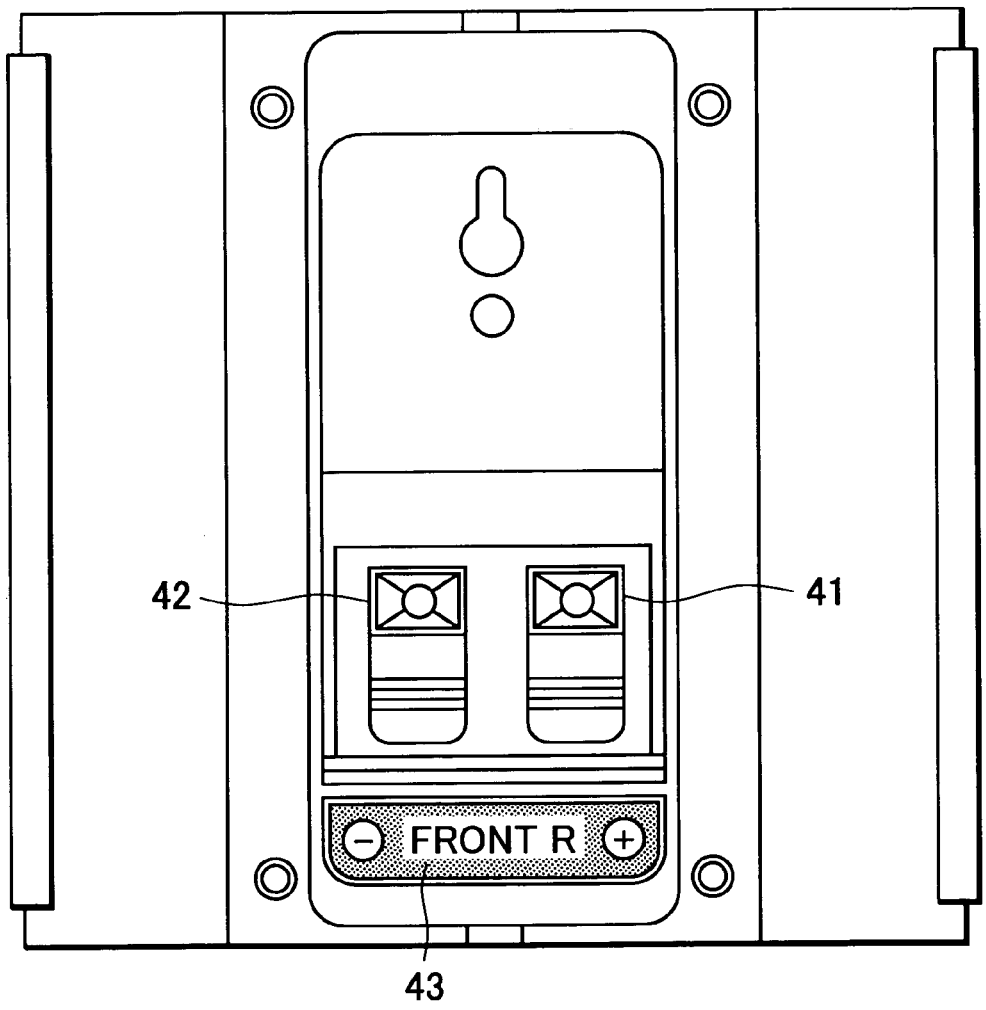
FIG. 6 is a schematic diagram showing a periphery of speaker terminals according to an embodiment of the present invention.

FIG. 6 is a rear view of the speaker 3FR provided for the front-right channel. The speaker 3FR is fitted with a pair of sandwiching-type terminals 41 and 42. A red label 43 printed with a letter "Front R" designating the front-right channel and the positive and negative polarities is adhered to a location close to the terminals 41 and 42.

Each label designates the positive and negative polarities with white and black colors in correspondence with white and black colors provided for the above-referred polarity-discerning thermally contractile tubes 31 and 32 used for each of the connecting cable members.

Figure 7:
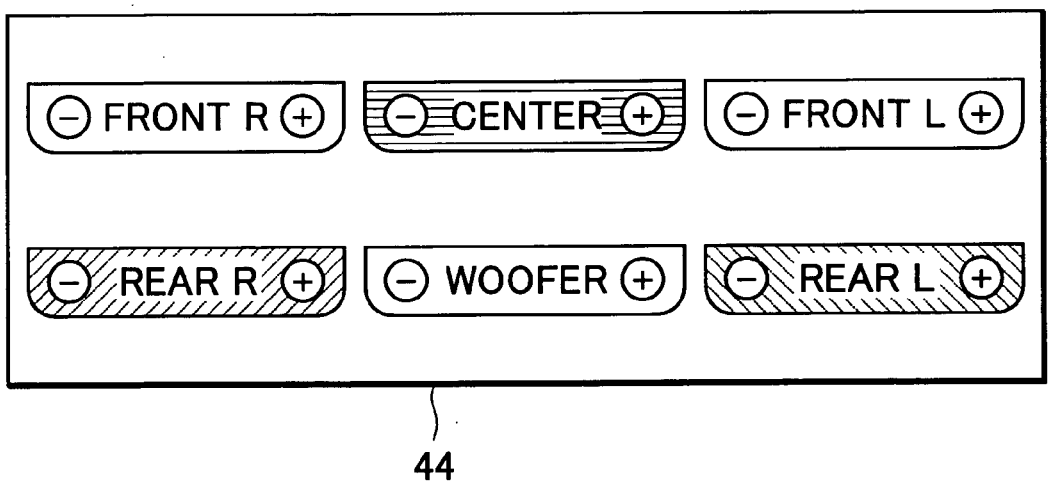
FIG. 7 is a schematic diagram explanatory of an embodiment of the present invention.

It is allowable to previously adhere labels including the red label 43 onto the rear surface of individual speakers 3FR, 3FL, 3RR, 3RL, 3C, and 3W. Instead, as shown in FIG. 7, it is also permissible to introduce such a method, in which, adhesive label sheets 44 previously printed with six labels corresponding to six channels and being capable of optionally stripping and re-adhering from and onto the rear panels of speakers are delivered to each setting operator in advance to enable him to adhere the adhesive label sheets 44 onto rear panels of individual channel speakers.

Next, serial procedures for implementing connection between audio signal output terminals and speakers per channel by way of utilizing the above-referred audio signal output terminals 11 of the DVD player 10, individual connecting cable members 21FR, 21FL, 21RR, 21RL, 21C, and 21W in combination with those speakers 3FR, 3FL, 3RR, 3RL, 3C, and 3W, provided for individual output channels, are described below.

Step 1:

First, a plug 23 secured to a connecting cable member is inserted into a corresponding socket, where the plug 23 bears a specific color identical to that of a sheet adhered to the socket portion functioning itself as one of audio signal output terminals. Upon completion of the inserting process, the positive and negative polarities of the above components automatically match with each other.

Step 2:

By referring to the above-referred thermally contractile tubes 31 and 32 used for identifying both polarities and by way of checking and confirming both polarities and colors designating both polarities, a pair of tip portions 28 of each connecting cable member fitted with a thermally contractile tube 33 bearing a specific color identical to that of a channel-name designating label adhered to a corresponding speaker are then inserted into the positive terminal and the negative terminal of the speaker.

Step 3:

The cable-connected speaker is disposed to a position corresponding to the channel-name designating label of the speaker.

By orderly implementing the above processes, it is possible for the setting operator to easily and correctly connect an electronic apparatus fitted with audio signal output terminals to a plurality of speakers without confusing channels and inverting polarities, and yet, he can adequately install individual speakers corresponding to predetermined channels onto correct positions.

Figure 8:
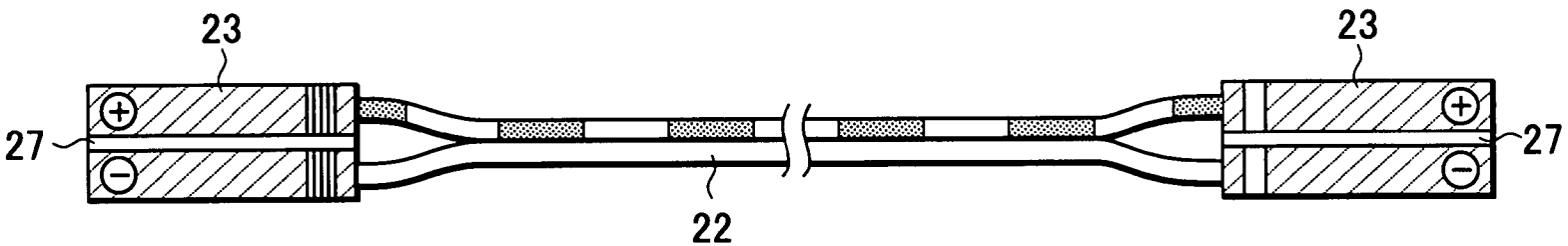
FIG. 8 is another construction of a connecting cable member according to another embodiment of the present invention.

In the above-described embodiments of the present invention, a plug 23 is solely secured to one end of a connecting cable member, whereas the other end is connected to a corresponding speaker via a conventional pitching method. Alternatively, as shown in FIG. 8, both ends of each connecting cable member may be secured with the plugs 23.

When implementing the above alternative method, it is so arranged that a pair of plugs 23 at both ends of a connecting cable member are respectively coated with such a color identical to that of an output channel utilizing these plugs 23.

Figure 9:
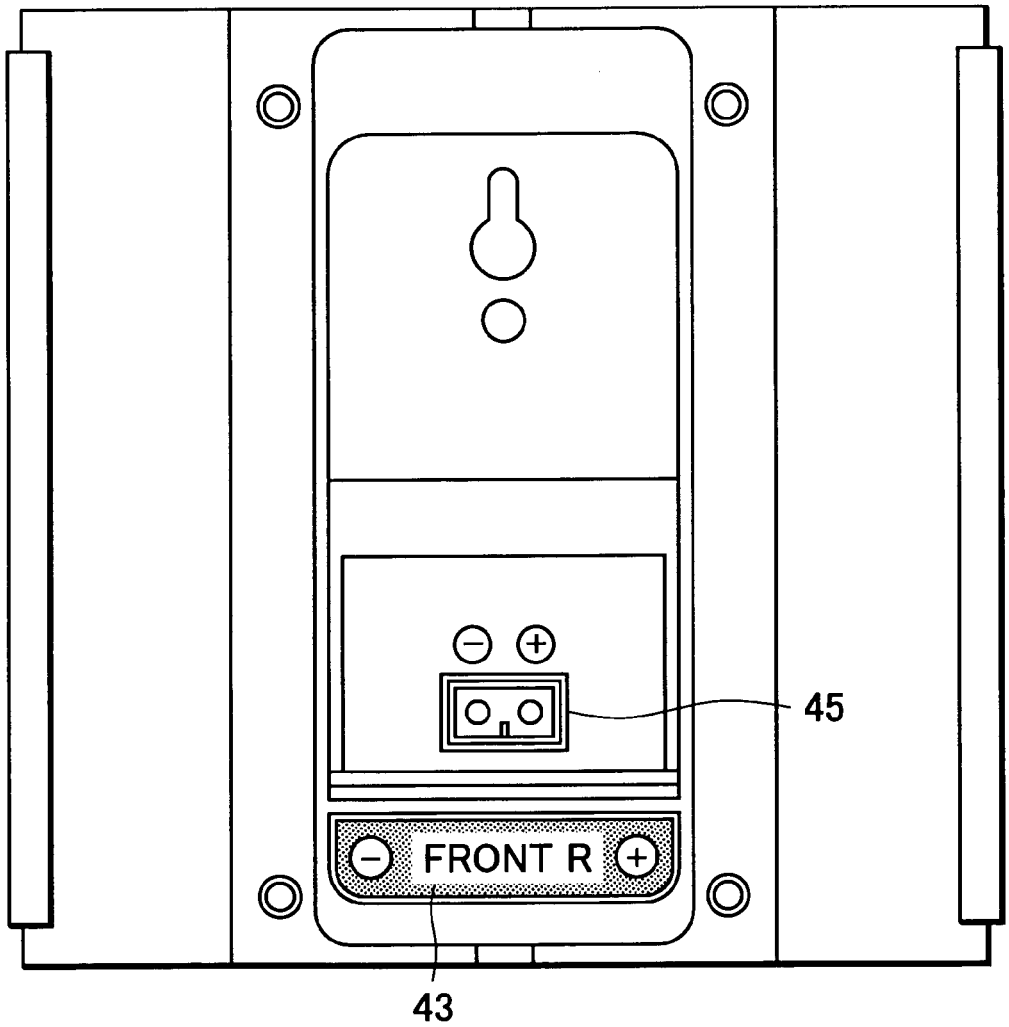
FIG. 9 is a schematic diagram showing a periphery of speaker terminals according to another embodiment of the present invention.

In this embodiment, as shown in FIG. 9, each of speaker terminals comprises a socket 45 having a structure identical to that of a socket provided for each of the audio signal output terminals shown in FIG. 2 and FIG. 3. In the example shown in FIG. 9, a label printed with the channel name and both polarities is adhered to a location close to the socket 45. In place of this label 43, it is also allowable to adhere such a sheet identical to the sheets 13FR, 13FL, 13RR, 13RL, 13C, and 13W shown in FIG. 2 in the periphery of the socket 45 of a corresponding speaker. In this case, it is suggested that the sheet should be printed with the channel name and both polarities.

When implementing the embodiment as shown in FIG. 9, in the above-referred step 2 for specifying a procedure to connect an electronic apparatus fitted with audio signal output terminals to corresponding speakers, it is suggested that such a plug 23 provided for a connecting cable member fitted with a plug 23 bearing a specific color identical to that of a label designating the channel name and both polarities should merely be inserted into a corresponding socket of the corresponding speaker. In this case, when the plug 23 is inserted into the socket 45, proper polarity relationship is secured.

When implementing the above embodiments, by way of providing the connecting cable member with a plug fitted with a pair of jack holes, both the audio signal output terminals and speaker terminals are formed in conformity with a socket structure. Instead of this, it is also allowable to provide each of the connecting cable members with such a structure identical to that of the socket, and likewise, such a structure identical to that of the plug may be provided for the audio signal output terminals and the speaker terminals as well.

It should be understood that constructions of the above-referred plug 23 and socket 45 is by no means limited to the one conforming to the above-described practical forms for implementing the present invention.

In the above described embodiments of the present invention, a rib member 18 functioning as a position-controlling member is provided. However, for example, it is also allowable to provide a guide slit on the bottom surface of a socket recess 15 and also provide a projecting rib member 18 on the part of a corresponding plug 23 in order that the projecting rib member 18 can be coupled with the guide slit.

Moreover, it is also possible to provide the plug 23 and respective socket 45 in which the proper polarity insertion can be secured by, for example, instead of the projecting rib, the plug 23 having an asymmetric cross section, that is, the shape of the plug and the socket 45 to which it is connected to are such that the portion corresponding to one polarity has a shape that is different from the shape of the other polarity, thus resulting in a conformation that avoids inversion of the polarities when making the connection.

Further, in the above described embodiments of the present invention, as shown in FIG. 1 and FIG. 2, six sockets are disposed to the upper and lower two ranks three by three. Instead of this, it is also allowable to dispose them to the upper and lower three ranks two by two for example (not shown). Concretely, it is allowable to implement such an arrangement comprising the following: The socket 12FR provided for the front-right channel and the socket 12FL provided for the front-left channel are disposed to both sides at the upper rank as seen from an electronic apparatus, whereas the socket 12C provided for the center channel and the socket 12W provided for the bass-only channel are disposed on both sides of the middle rank, and yet, the socket 12RR provided for the rear-right channel and the socket 12RL provided for the rear-left channel are disposed to both sides of the bottom rank, respectively. Further, it is also allowable to horizontally align six sockets altogether. In this case, such an arrangement is implemented, in which, the socket 12C provided for the center channel and the socket 12W provided for the bass-only channel are aligned in the center, whereas the socket 12RR provided for the rear-right channel and the socket 12FR provided for the front-right channel are respectively aligned to the left. On the other hand, the socket 12FL provided for the front-left channel and the socket 12RL provided for the rear-left channel are respectively aligned to the right. As described above, depending on available space and design for allowing disposition of sockets on the back panel of an electronic apparatus, arrangement of individual sockets can optionally be selected.

It should also be understood that, not only speaker cables, but any of the connecting cable members introduced for implementing the above embodiments is also applicable for discernibly identifying a pair of inverse polarities for example, the above-referred connecting cable members may also be applied to a coaxial cable as well.

Still, although the description of the preferred embodiments of the present invention is done to embodiments in which the described terminals and cables are differentiated by color, it is also possible to provide other methods of differentiation by look, touch or the like, such as different shaping for the terminals and cables, marking of the surface of the cable by using symbols including print patterns, letters and numbers, different textures of the surface of the cable and the like.

As it is clear from the above description, according to the embodiments of the present invention, it is so arranged that a plurality of connecting cable members corresponding to audio signal output terminals of an electronic apparatus fitted with audio signal output terminals are orderly aligned without intersecting each other.

Further, when executing a process for connecting output terminals to the corresponding connecting cable members in which alignment of polarities becomes a critical problem, the inventive method enables connection to be consummated between them without taking the polarity problem into consideration.

According to the invention, when setting up a multi-channel audio system, it is possible to easily connect an electronic apparatus fitted with audio signal output terminals to a plurality of speakers without confusing channel relationship and inverting polarities to make it possible to properly set multi-channel speakers at correct positions.

What is claimed is:

1. A multi-channel audio system comprising:

an electronic apparatus having a back panel with at least five audio signal output terminals for a plurality of channels, said at least five audio signal output terminals including a front right audio signal output terminal for a front right channel, a rear right audio signal output terminal for a rear right channel, a front left audio signal output terminal for a front left channel, a rear left audio signal output terminal for a rear left channel and a center audio signal output terminal for a center channel, said back panel being located on a rear portion of the electronic apparatus;

a plurality of speakers for generating acoustic output for each of said plurality of channels in a form of audio signals output from said audio signal output terminals; and a plurality of connecting cable members, each of said cable members incorporating a pair of conductor members bearing a pair of polarities and sheathed by one of a plurality of insulating sheathing members for connecting said electronic apparatus to said plurality of speakers, in which, as viewed from the rear portion of the electronic apparatus, the front left audio signal output terminal is arranged to the right of both of the front right audio signal output terminal and the rear right audio signal output terminal on the back panel, the rear left audio signal output terminal is arranged to the right of both of the front right audio signal output terminal and the rear right audio signal output terminal on the back panel, and the center audio signal output terminal is arranged in between the front left audio signal output terminal and the front right audio signal output terminal, in which the front right audio signal output terminal is arranged on top of the rear right audio signal output terminal, and the front left audio signal output terminal is arranged on top of the rear left audio signal output terminal, or in which the front right audio signal output terminal is arranged below the rear right audio signal output terminal, and the front left audio signal output terminal is arranged below the rear left audio signal output terminal, each of said audio signal output terminals is distinguished by one of a plurality of different respective colors for enabling each of said plurality of channels and black and white colored marks for a pair of polarities to be discernable, a name of a corresponding audio output channel, a pair of polarities, and a colored mark that shows discernment corresponding to channels of the respective output terminal is displayed surrounding the respective output terminal on the back panel of the electronic apparatus whereat the audio signal output terminals are located; and each of the plurality of connecting cable members is distinguished by one of said plurality of colors corresponding to a color distribution of said colored marks surrounding each of said audio signal output terminals, wherein, for each of the connecting cable members, the sheathing member is distinguished by a different colored mark at a portion corresponding to each of the pair of conductor members, and wherein each of said plurality of connecting cable members incorporates (i) a pair of thermally contractile tubes bearing respective black and white color marks for enabling the pair of polarities of the pair of conductor members of the connecting cable member to be discernable and (ii) a second thermally contractile tube bearing one of said plurality of colors corresponding to the color distribution of said colored marks surrounding each of said audio signal output terminals, the second tube being secured to the sheathing member of the connecting cable member at a portion of the sheathing member at which the portions of the sheathing member corresponding to the pair of conductors split from each other in a direction of one end of the connecting cable member and extend integrated in a direction of the other end of the connecting cable member such that the portions of the sheathing member having the different colored marks corresponding to the pair of conductor members extend from the second tube toward both ends of the connecting cable member, and the one end of each said connecting cable member has a plug connector structure fitted with said pair of conductor members in the form of a pair of coupling holes respectively connected to two conductor portions wherein each of said plug connector structure has a different respective color corresponding to the color distribution of said plurality of colored marks surrounding said audio signal output terminals;

said audio signal output terminals conform to a socket connector structure coupled with said plug connector member formed on one end of said connecting cable member;

each said socket connector mounted on the back panel of the electronic apparatus has a pair of connecting pins bearing a pair of polarities and position-controlling member for matching said polarities when an other of said plug connectors is coupled with said socket connector;

said pair of coupling holes are to be coupled with two connecting pins and said plug connector includes a position-controlling structure coupling portion to be coupled with said position-controlling member of said socket connector for matching said polarities;

wherein the position-controlling structure has two slits of different depth, in which one slit has a depth allowing insertion of said position-controlling member, and the other slit has a depth inhibiting the insertion of said position-controlling member, so as to prevent improper connection between the position-controlling structure and the position-controlling member.

2. The multi-channel audio system according to claim 1, wherein one of said plug connector members is secured to each end of each of said plurality of connecting cable members and one of said socket connectors is secured to each of said plurality of speaker terminals, wherein said plug connector members on each connecting cable member are the same color.

3. The multi-channel audio system of claim 1, wherein each of the plug connector structure and the socket connector structure has an asymmetric cross section such that one polarity thereof has a shape different from that of the other polarity.

4. A multi-channel audio system comprising:

an electronic apparatus having a plurality of audio signal output terminals compatible with at least five of a plurality of channels and being mounted on a rear panel thereof, said at least five audio signal output terminals including a front right audio signal output terminal for a front right channel, a rear right audio signal output terminal for a rear right channel, a front left audio signal output terminal for a front left channel, a rear left audio signal output terminal for a rear left channel, and a center audio signal output terminal for a center channel, said rear panel being located on a rear portion of the electronic apparatus;

a plurality of speakers for generating acoustic output for each of said plurality of channels in the form of an audio signal output from each of said plurality of audio signal output terminals, wherein a plurality of colored labels are attached respectively to rear surfaces of said plurality of speakers, and wherein each colored label has a different respective color; and a plurality of connecting cable members each having a pair of conductor members bearing a pair of polarities and colored marks to discern polarities, and each of said plurality of connecting cable members are individually sheathed with an insulating sheathing member and used for connecting said electronic apparatus and said plurality of speakers, said audio signal output terminals are arranged corresponding to expected positions of said plurality of speakers such that, as viewed from the rear portion of the electronic apparatus, the front left audio signal output terminal is arranged to the right of both of the front right audio signal output terminal and the rear right audio signal output terminal on the back panel, and the rear left audio signal output terminal is arranged to the right of both of the front right audio signal output terminal and the rear right audio signal output terminal on the back panel, and the center audio signal output terminal is arranged in between the front left audio signal output terminal and the front right audio signal output terminal, in which the front right audio signal output terminal is arranged on top of the rear right audio signal output terminal and the front left audio signal output terminal is arranged on top of the rear left audio signal output terminal or in which the front right audio signal output terminal is arranged below the rear right audio signal output terminal and the front left audio signal output terminal is arranged below the rear left audio signal output terminal, said plurality of channels provided for said electronic apparatus are individually distinguished by a name of a corresponding audio output channel, a pair of polarities, and a plurality of different colored sheets affixed respectively surrounding said audio signal output terminals to visually discern individual channels, wherein a color distribution of said colored sheets corresponds to a color distribution of said colored labels; and said plurality of connecting cable members is provided with specific different colors corresponding to a color distribution of said colors of said plurality of colored sheets respectively surrounding said plurality of audio signal output terminals for visual discernment of individual channels and corresponding to a color distribution of said plurality of colored labels affixed to said plurality of speakers, wherein, for each of the connecting cable members, the sheathing member is distinguished by a different colored mark at a portion corresponding to each of the pair of conductor members;

wherein each of said plurality of connecting cable members incorporates (i) a pair of plurality of thermally contractile tubes bearing respective black and white color marks for enabling the pair of polarities of the pair of conductor members of the connecting cable member to be discernable and (ii) a second thermally contractile tube bearing one of said plurality of colors corresponding to the color distribution of said colored sheets affixed respectively surrounding said audio signal output terminals, the second tube being secured to the sheathing member of the connecting cable member at a portion of the sheathing member at which the portions of the sheathing member corresponding to the pair of conductors split from each other in a direction of one end of the connecting cable member and extend integrated in a direction of the other end of the connecting cable member such that the portions of the sheathing member having the different colored marks corresponding to the pair of conductor members extend from the second tube toward both ends of the connecting cable member, the one end of each of said plurality of connecting cable members has a plug connector structure fitted with a pair of coupling holes bearing a pair of polarities each connected to two conductor portions, wherein each said plug connector structure has a different respective color corresponding to the color distribution of said plurality of colored labels and said plurality of colored sheets;

each of said plurality of audio signal output terminals conforms to a socket connector structure mounted on the rear panel of the electronic apparatus and has a pair of coupling pins for coupling with the coupling holes said plug connector member;

said plug connector member has position-controlling structure for matching said polarities when coupled with one of said socket connector members; and each of said socket connector members has a position-controlling member coupling portion coupled with said position-controlling structure of said plug connector member for matching said polarities;

wherein the position-controlling structure has two slits of different depth, in which one slit has a depth allowing insertion of said position-controlling member, and the other slit has a depth inhibiting the insertion of said position-controlling member, so as to prevent improper connection between the position-controlling structure and the position-controlling member.

5. The multi-channel audio system of claim 4, wherein each of the plug connector structure and the socket connector structure has an asymmetric cross section such that one polarity thereof has a shape different from that of the other polarity.

6. A multi-channel audio system comprising:

an electronic apparatus having a back panel with at least five audio signal output terminals for a plurality of channels, said at least five audio signal output terminals including a front right audio signal output terminal for a front right channel, a rear right audio signal output terminal for a rear right channel, a front left audio signal output terminal for a front left channel, a rear left audio signal output terminal for a rear left channel, and a center audio signal output terminal for a center channel, said back panel being located on a rear portion of the electronic apparatus;

a plurality of speakers for generating acoustic output for each of said plurality of channels in a form of audio signals output from said audio signal output terminals; and a plurality of connecting cable members, each of said plurality of connecting cable members incorporating a pair of conductor members bearing a pair of polarities and sheathed by one of a plurality of insulating sheath members for connecting said electronic apparatus to said plurality of speakers, in which, as viewed from the rear portion of the electronic apparatus, the front left audio signal output terminal is arranged to the right of both of the front right audio signal output terminal and the rear right audio signal output terminal on the back panel, and the rear left audio signal output terminal is arranged to the right of both of the front right audio signal output terminal and the rear right audio signal output terminal on the back panel, and the center audio signal output terminal is arranged in between the front left audio signal output terminal and the front right audio signal output terminal, in which the front right audio signal output terminal is arranged on top of the rear right audio signal output terminal, and the front left audio signal output terminal is arranged on top of the rear left audio signal output terminal, or in which the front right audio signal output terminal is arranged below the rear right audio signal output terminal, and the front left audio signal output terminal is arranged below the rear left audio signal output terminal;

each of the plurality of connecting cable members is distinguished by one of a plurality of colors corresponding to a color distribution of color markings respectively at said audio signal output terminals for visual discernment of individual channels, wherein, for each of the connecting cable members, the sheathing member is distinguished by a different colored mark at a portion corresponding to each of the pair of conductors;

wherein each of said plurality of connecting cable members incorporates (i) a pair of thermally contractile tubes bearing respective black and white color marks for enabling the pair of polarities of the pair of conductor members of the connecting cable member to be discernable and (ii) a second thermally contractile tube bearing one of said plurality of colors corresponding to the color distribution of color marking respectively at said audio signal output terminals, the second tube being secured to the sheathing member of the connecting cable member at a portion of the sheathing member at which the portions of the sheathing member corresponding to the pair of conductors split from each other in a direction of one end of the connecting cable member and extend integrated in a direction of the other end of the connecting cable member such that the portions of the sheathing member having the different colored marks corresponding to the pair of conductor members extend from the second tube toward both ends of the connecting cable member, wherein the one end of each said connecting cable member has a plug connector structure fitted with said pair of conductor members in the form of a pair of coupling holes respectively connected to two conductor portions;

wherein said audio signal output terminals conform to a socket connector structure coupled with said plug connector formed on one end of said connecting cable member;

each said socket connector has a pair of connecting pins bearing a pair of polarities and position-controlling member for matching said polarities when an other of said plug connectors is coupled with said socket connector;

said pair of coupling holes are to be coupled with two connecting pins and said plug connector includes a position-controlling structure coupling portion to be coupled with said position-controlling member of said socket connector for matching said polarities;

said position-controlling structure has two slits of different depth, in which one slit has a depth allowing insertion of said position-controlling member, and the other slit has a depth inhibiting the insertion of said position-controlling member, so as to prevent improper connection between the position-controlling structure and the position-controlling member.

7. The multi-channel audio system of claim 6, wherein each of the plug connector structure and the socket connector structure has an asymmetric cross section such that one polarity thereof has a shape different from that of the other polarity.

* * * * *